US009249796B2

(12) United States Patent
Jackson et al.

(10) Patent No.: US 9,249,796 B2
(45) Date of Patent: Feb. 2, 2016

(54) DISPOSABLE POSITIVE DISPLACEMENT DOSING PUMP

(75) Inventors: Jeffrey L. Jackson, Lino Lakes, MN (US); Alan S. Peterson, Maple Grove, MN (US); Eric A. Isberg, Maple Grove, MN (US)

(73) Assignee: Robert Bosch Packaging Technology, Inc., Minneapolis, MN (US)

( * ) Notice: Subject to any disclaimer, the term of this patent is extended or adjusted under 35 U.S.C. 154(b) by 0 days.

(21) Appl. No.: 11/724,824

(22) Filed: Mar. 16, 2007

(65) Prior Publication Data

US 2008/0226468 A1 Sep. 18, 2008

(51) Int. Cl.

| | |
|---|---|
| ***F04B 9/02*** | (2006.01) |
| ***F04B 53/14*** | (2006.01) |
| ***F04B 53/00*** | (2006.01) |
| ***B65B 3/12*** | (2006.01) |
| ***F04B 13/00*** | (2006.01) |
| ***F04B 43/00*** | (2006.01) |
| ***F04B 43/02*** | (2006.01) |

(52) U.S. Cl.

CPC ..... *F04B 53/143* (2013.01); *B65B 3/12* (2013.01); *F04B 13/00* (2013.01); *F04B 43/0063* (2013.01); *F04B 43/021* (2013.01); *F04B 53/008* (2013.01)

(58) Field of Classification Search

CPC ..... F04B 39/0005; F04B 39/0022; F04B 53/143; F04B 53/02; F04B 53/008; F04B 43/067; F04B 9/025; F04B 53/22; F04B 43/0063

USPC ..... 92/98 D, 98 R; 417/395, 571, 470

See application file for complete search history.

(56) References Cited

U.S. PATENT DOCUMENTS

| | | | | | |
|---|---|---|---|---|---|
| 3,106,387 | A | * | 10/1963 | Francis | 267/34 |
| 3,880,053 | A | | 4/1975 | Trechsel et al. | |
| 4,091,969 | A | | 5/1978 | Easter et al. | |
| 4,212,416 | A | | 7/1980 | Bennett | |
| 4,468,222 | A | * | 8/1984 | Lundquist | 604/153 |
| 4,569,378 | A | | 2/1986 | Bergandy | |
| 5,138,936 | A | * | 8/1992 | Kent | 92/98 D |
| 5,154,589 | A | | 10/1992 | Ruhl et al. | |
| 5,480,063 | A | | 1/1996 | Keyes et al. | |

(Continued)

FOREIGN PATENT DOCUMENTS

| | | | | |
|---|---|---|---|---|
| WO | WO 91/19099 | | 12/1991 | |
| WO | WO2006122268 | * | 11/2006 | F04B 23/04 |

OTHER PUBLICATIONS

"Single-Use Disposable Filling for Sterile Pharmaceuticals," Pharmaceutical Technology May/Jun. 2003, by Brett Belongia, PhD, Robert Blanck and Steve Tingley, pp. 126-128, 130-134.

(Continued)

*Primary Examiner* — Bryan Lettman

(74) *Attorney, Agent, or Firm* — Michael Best & Friedrich

(57) ABSTRACT

A disposable positive displacement pump is disclosed. The pump includes a pump housing having head portion and a body, the head portion having one or more fluid passage openings. The pump also includes a rolling diaphragm internal to the pump housing and defining a fluid chamber within the pump housing. The pump further includes a piston drive unit configured to reciprocally drive the rolling diaphragm to move fluid in or out of the fluid chamber. A method of dispensing a fluid is also disclosed.

17 Claims, 12 Drawing Sheets

(56) References Cited

U.S. PATENT DOCUMENTS

| | | | | |
|---|---|---|---|---|
| 5,540,568 | A * | 7/1996 | Rosen et al. | 417/395 |
| 5,611,681 | A * | 3/1997 | Everitt | F04B 15/00 137/533 |
| 5,680,960 | A | 10/1997 | Keyes et al. | |
| 7,118,011 | B2 | 10/2006 | Proulx | |
| 2002/0048519 | A1 | 4/2002 | Spiteri-Gonzi et al. | |
| 2004/0208750 | A1 * | 10/2004 | Masuda | 417/42 |
| 2006/0171828 | A1 * | 8/2006 | Uehara et al. | 417/571 |
| 2009/0068032 | A1 * | 3/2009 | Furey | 417/395 |

OTHER PUBLICATIONS

Disposable Technologies within Aseptic Processing, American Pharmaceutical Review, by Angelo Colombo and Per Sivertsson, pp. 24, 26-28, no date.

* cited by examiner

DISPOSABLE POSITIVE DISPLACEMENT DOSING PUMP

TECHNICAL FIELD

The present disclosure relates generally to dosing systems. In particular, the present disclosure relates to a disposable positive displacement dosing pump.

BACKGROUND

Dosing systems exist which are configured for repeatable, metered dispensing of fluids, such as medicines. The dosing systems generally include a pump system that drives a predetermined volume of fluid through tubing to a needle or nozzle assembly, which delivers the fluid into a container.

Various types of pumps can be used in such dosing systems. One such pump is a positive displacement pump. Positive displacement pumps generally incorporate a piston driven pump unit that includes a piston, a fluid chamber, and a body. The pump unit is used, in combination with timed valves, to encourage fluid travel through the pump chamber and the tubing. As compared to other pump systems, such as peristaltic pump systems, these positive displacement pump systems provide high speed, repeatable volume fluid delivery. Examples of positive displacement pumps are shown in U.S. Pat. No. 3,880,053, assigned to TL Systems Corporation, and U.S. Pat. No. 5,540,568, assigned to National Instrument Co., Inc. U.S. Pat. No. 5,540,568 describes a filling system including a rolling diaphragm incorporated into a disposable pump head module. In that system, the pump head is releasably sealable to a pump body, and includes a rolling diaphragm when disconnected from the pump body.

Certain positive displacement pump assemblies, including those mentioned above, incorporate a rolling diaphragm to separate the piston drive unit from the fluid chamber. The rolling diaphragm provides a number of advantages when used in a positive displacement pump. The rolling diaphragm provides a leakproof seal for the fluid within the pump. It also ensures gentle handling of the fluid to be delivered by minimizing the shearing of molecules within the liquid that may otherwise occur using a piston drive unit to drive the liquid. The rolling diaphragm also prevents the frictional wear of the piston drive unit from causing contamination of the fluid.

The existing positive displacement pumps and systems incorporating these pumps have a number of disadvantages when used in sterile operations. The manual dis-assembly, cleaning and re-assembly of these pumps and systems as well as additional clean-in-place and sterilize-in-place operations subtract time from operation of the dosing system and add significant cost to operate these types of systems. These process critical, yet required operations for sterile use of these existing positive displacement pumps and systems, offer opportunity and risk of accidental and unknown contamination thus compromising any product filled with said or suspect pump systems. Additionally, wear of the piston unit against the inner diameter of the body unit in existing positive displacement pumps (i.e. with out the use of a rolling diaphragm) can cause contamination of the sterile fluid during aforementioned sterile and clean product filling operations.

For these and other reasons, improvements are desirable.

SUMMARY

The above and other problems are solved by the following:

In a first aspect, a disposable positive displacement pump is disclosed. The pump includes a pump housing having head portion and a body, the head portion having one or more fluid passage openings. The pump also includes a rolling diaphragm internal to the pump housing and defining a fluid chamber within the pump housing. The pump further includes a piston drive unit configured to reciprocally drive the rolling diaphragm to move fluid in or out of the fluid chamber.

In a second aspect, a method of dispensing a fluid is disclosed. The method includes pumping a fluid from a fluid source using a disposable positive displacement pump. The pump includes a pump housing having head portion and a body, the head portion having one or more fluid passage openings. The pump further includes a rolling diaphragm internal to the pump housing and defining a fluid chamber within the pump housing. The pump also includes a piston drive unit configured to reciprocally drive the rolling diaphragm to move fluid in or out of the fluid chamber. The method optionally includes replacing the disposable positive displacement pump with a second disposable positive displacement pump.

In a third aspect, a disposable positive displacement pump is disclosed. The pump includes a pump housing having an integrally formed head portion and body, the head portion having one or more fluid passage openings. The pump also includes a rolling diaphragm internal to the pump housing and defining a fluid chamber within the head portion. The pump further includes a piston drive unit configured to reciprocally drive the rolling diaphragm to move fluid in or out of the fluid chamber. The pump also includes a pneumatic port providing an air outlet allowing a vacuum connection to the base portion and controlling withdrawal of the piston drive unit.

DETAILED DESCRIPTION

The present disclosure relates generally to a disposable positive displacement dosing system including a disposable positive displacement pump, and in certain aspects to disposable positive displacement pumps. The dosing system and dosing pump of the present disclosure are adapted for use in a variety of sterile and non-sterile applications, such as medicine or food product distribution, or other applications where repeatable delivery of accurate fluid volumes is desired. The dosing system and dosing pump can be used in filler machines. The system and pump disclosed are fully sealed and disposable, so as to prevent access to the fluid -interface portions of those systems, reducing the exposure of personnel operating the system to liquid product remaining within the pump that in certain cases may be harmful or cause illness at higher than rated exposure levels and where substantially contamination-free product is desired. The described system and pump are particularly suited for applications in pharmaceuticals where sterility is a requirement. The system and pump may be installed without requiring clean-inplace or sterilize-in-place procedures, thereby reducing the time in which the dosing system is non-operational.

Figure 1:
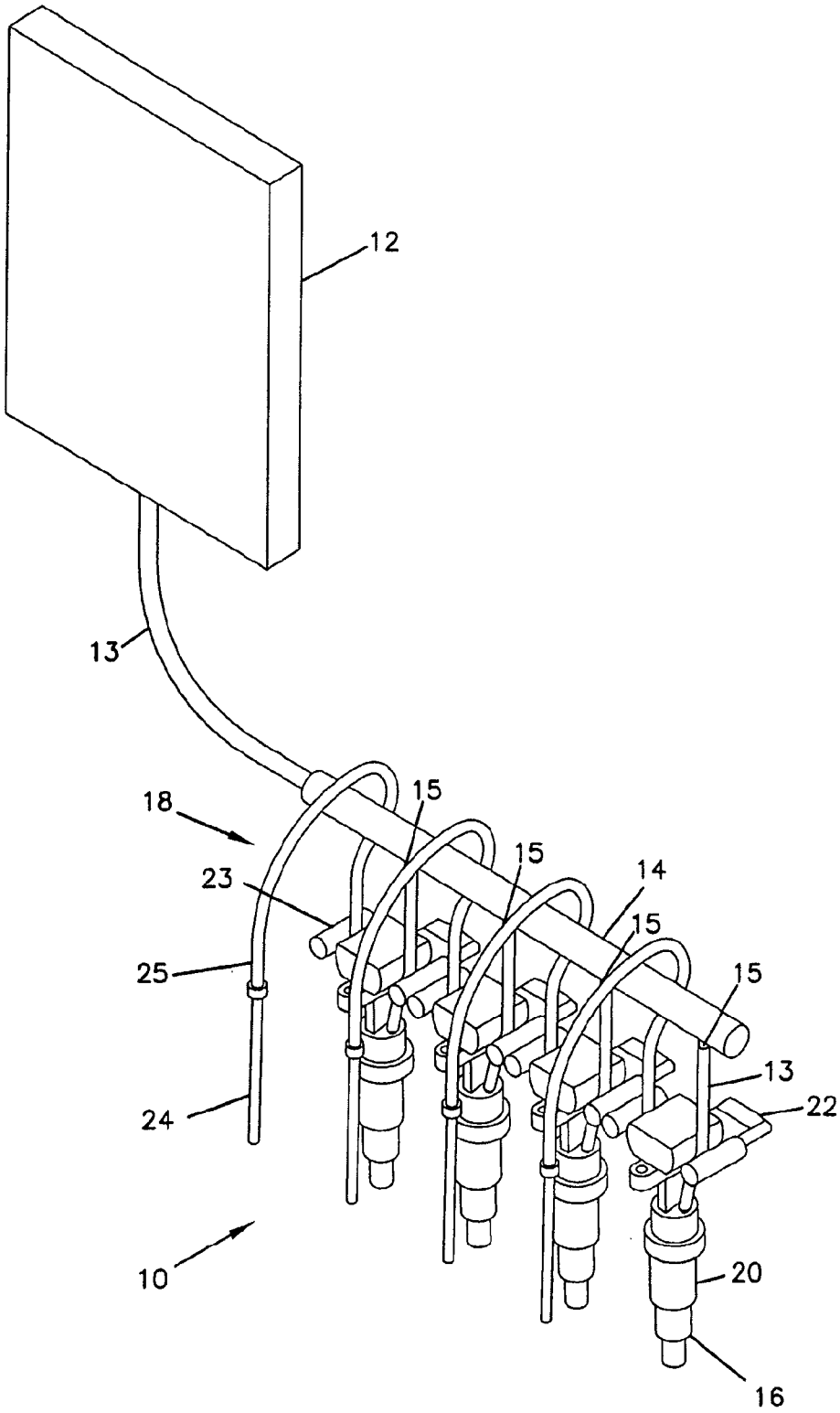
FIG. 1 shows a positive displacement dosing system according to a possible embodiment of the present disclosure.
Figure 2:
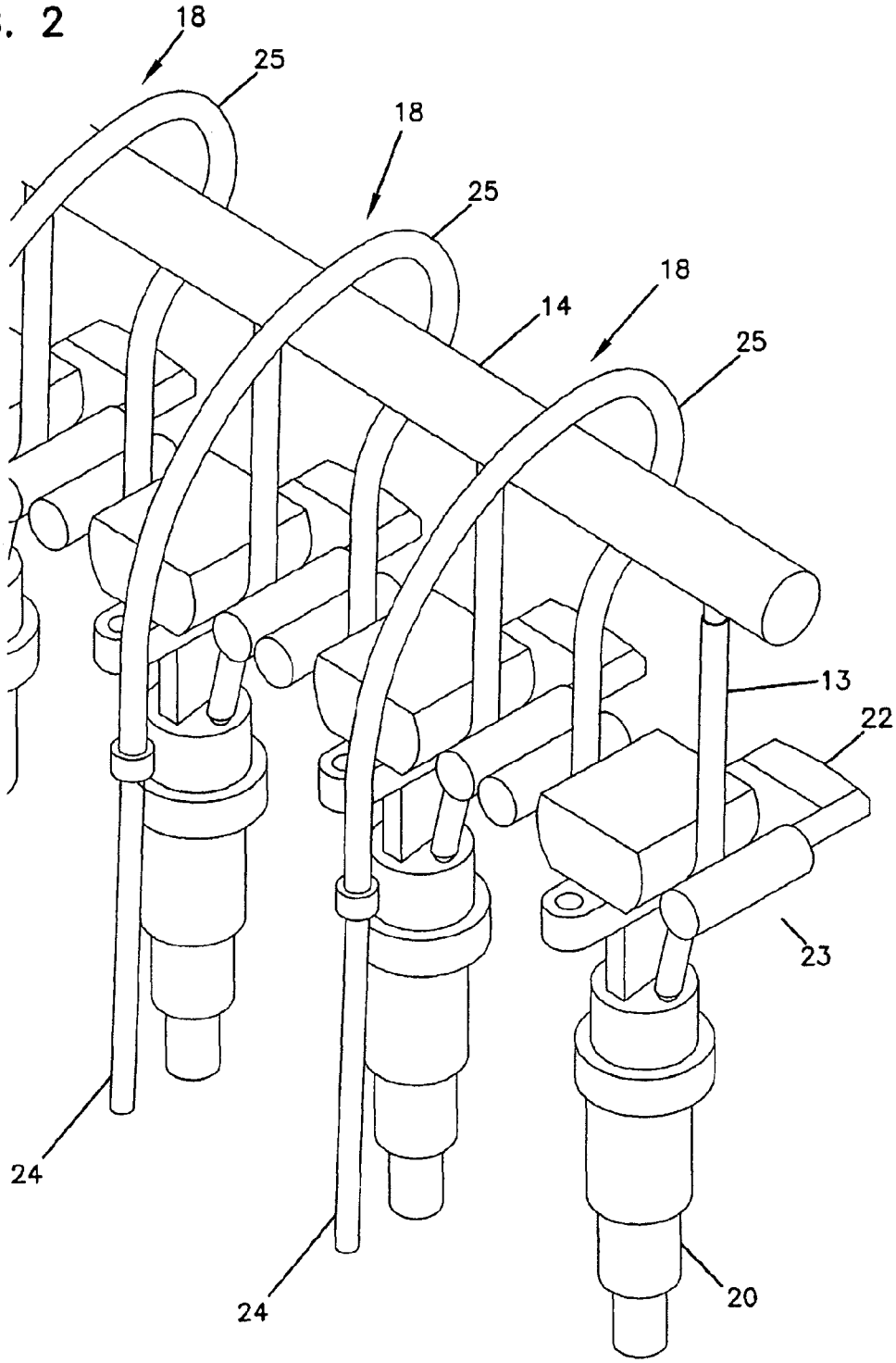
FIG. 2 shows a portion of the positive displacement dosing system of FIG. 1.
Figure 3:
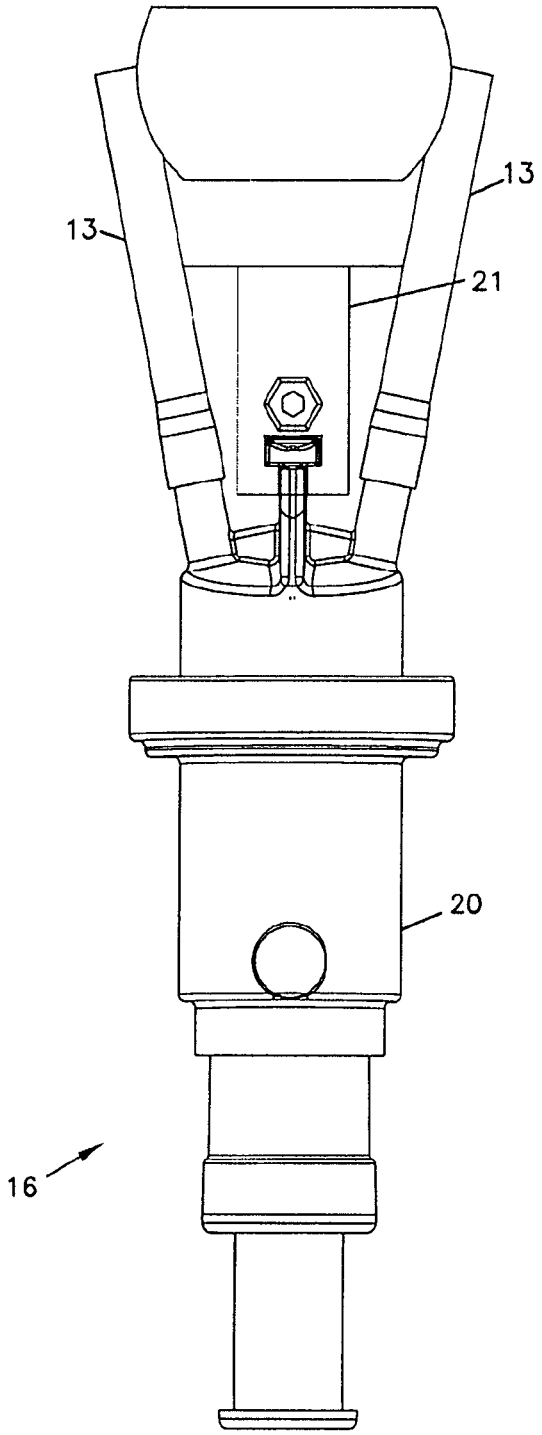
FIG. 3 is a front view of a portion of the positive displacement dosing system including a disposable positive displacement pump according to a possible embodiment of the present disclosure.
Figure 4:
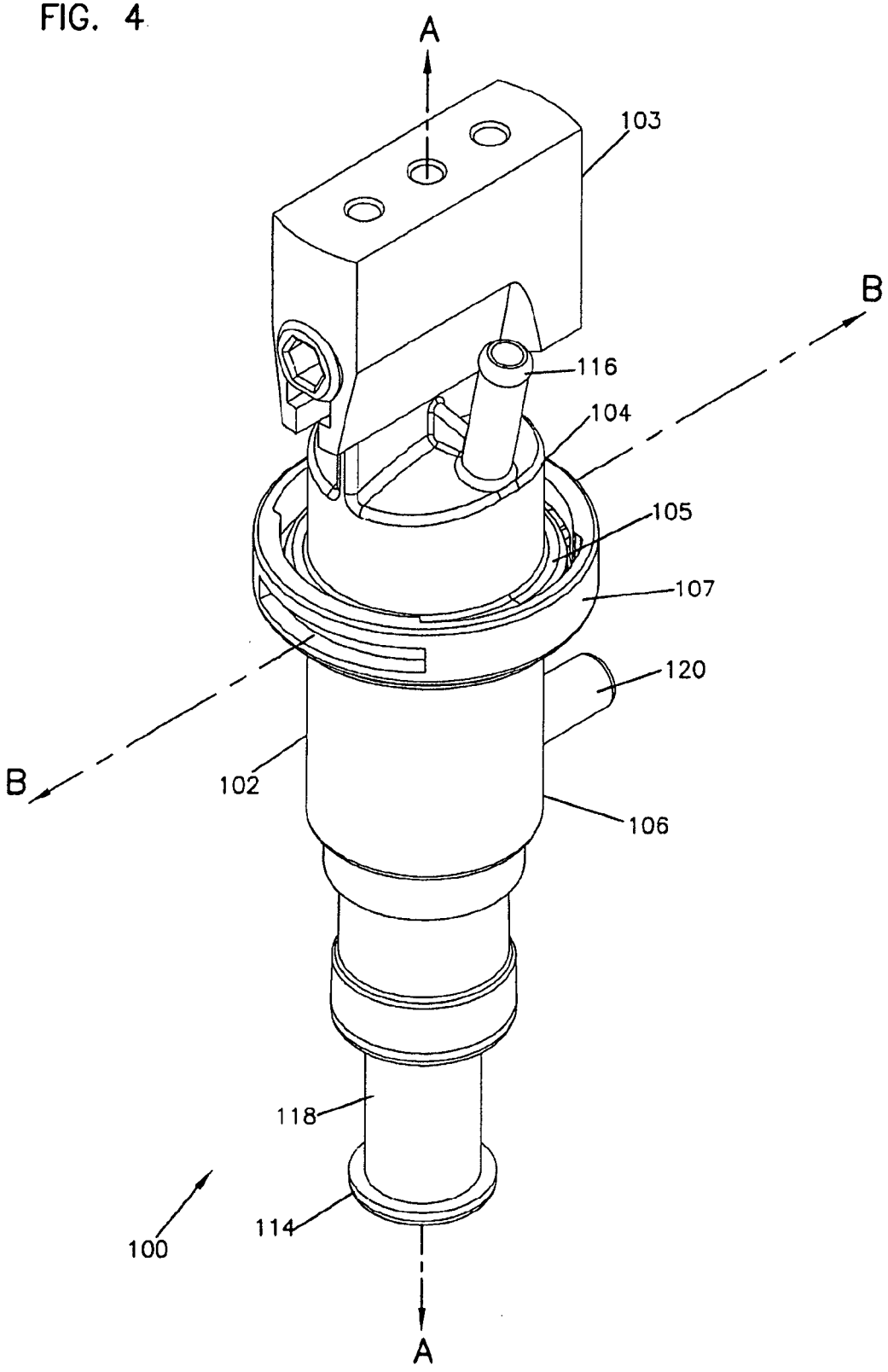
FIG. 4 is a front perspective view of a disposable positive displacement pump according to a possible embodiment of the present disclosure.
Figure 5:
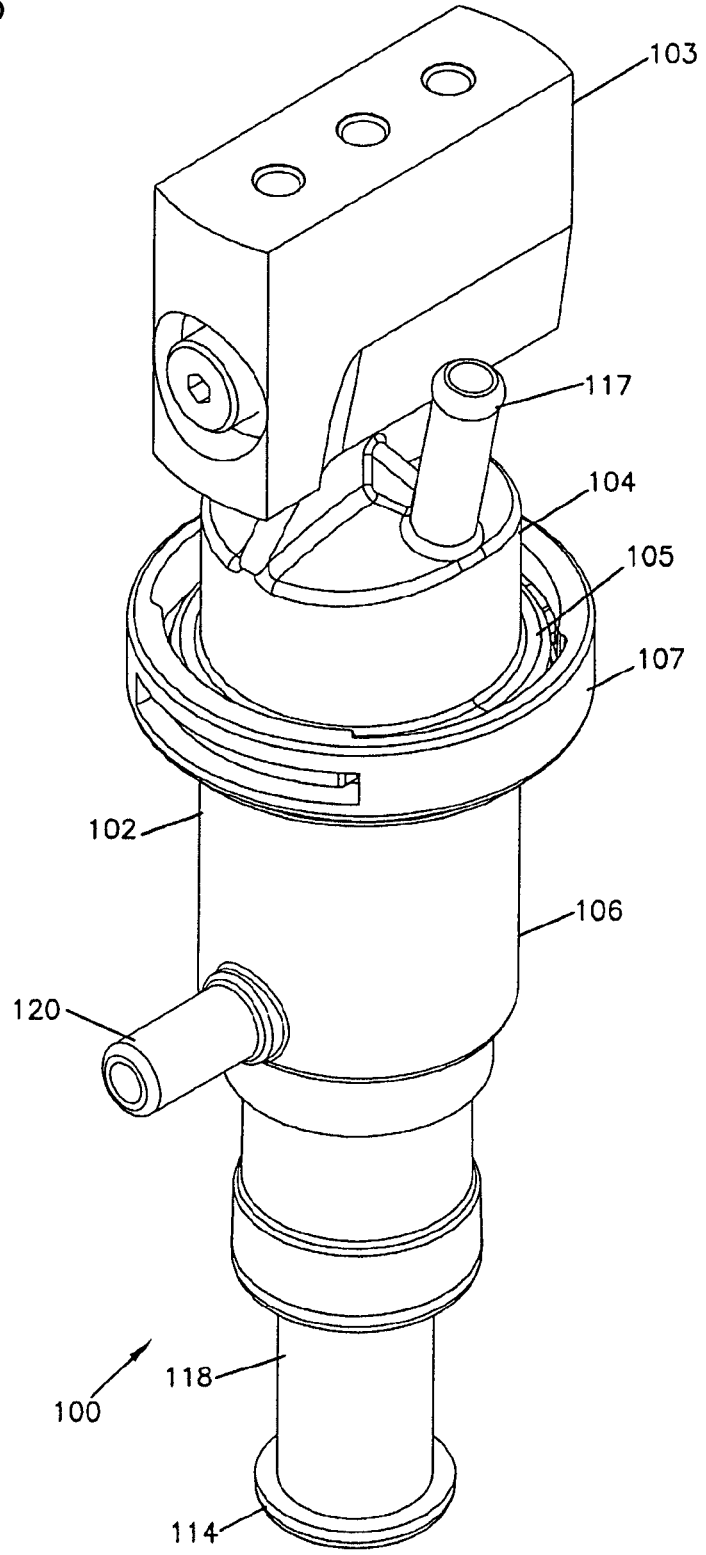
FIG. 5 is a rear perspective view of the disposable positive displacement pump of FIG. 4.
Figure 6:
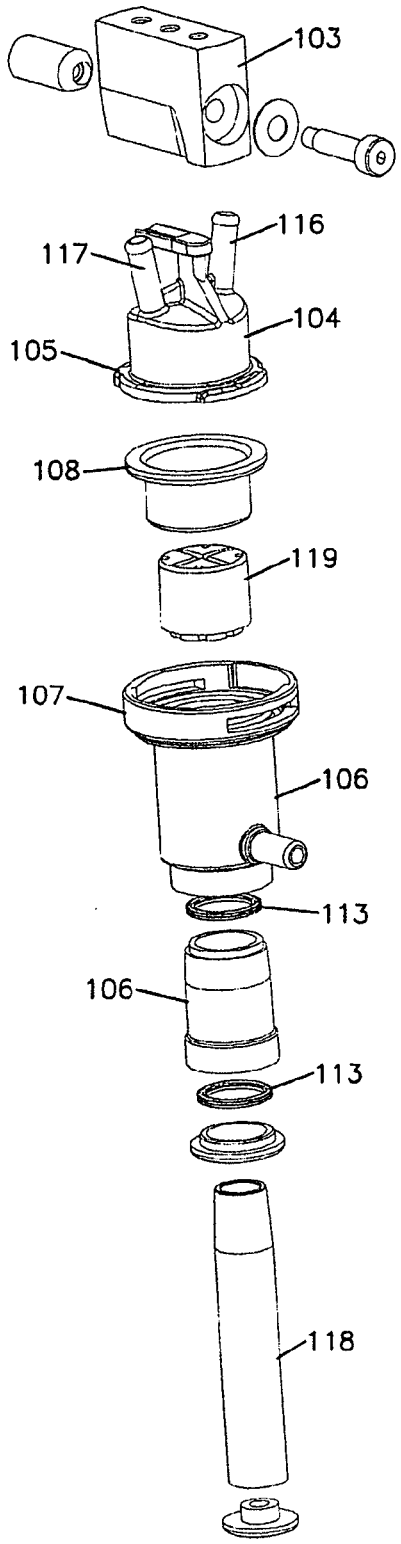
FIG. 6 is an exploded perspective view of the disposable positive displacement pump of FIG. 4.
Figure 7:
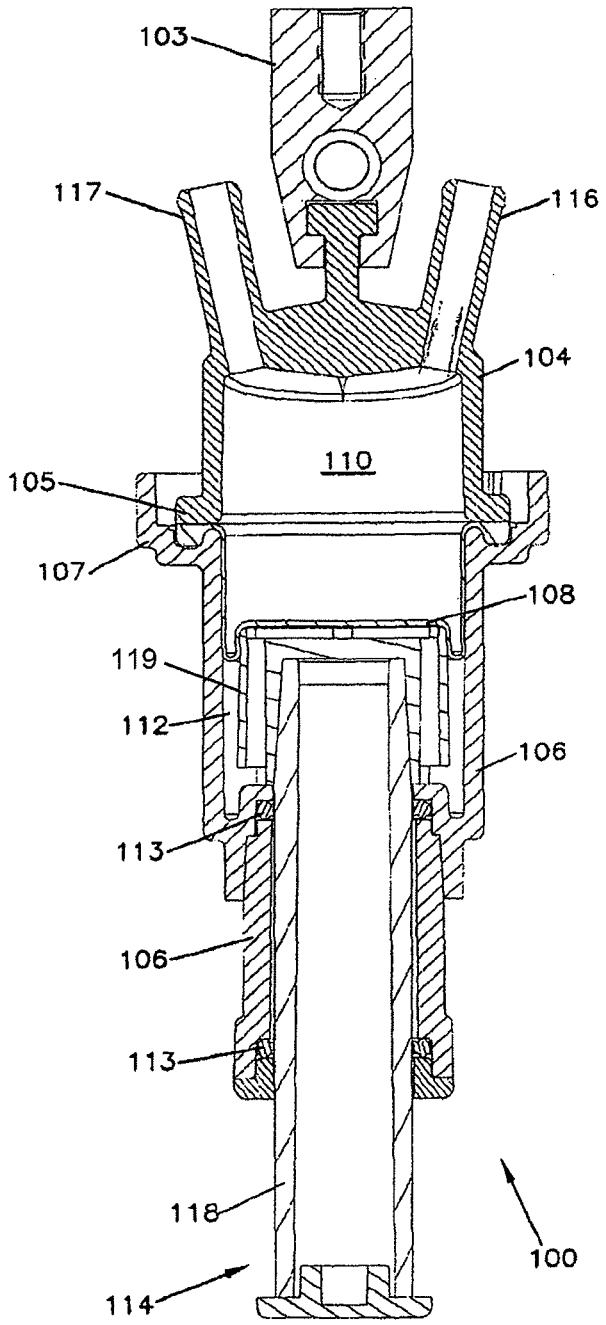
FIG. 7 is a front cross-sectional view of the disposable positive displacement pump of FIG. 4 taken along a plane including axis A.
Figure 8:
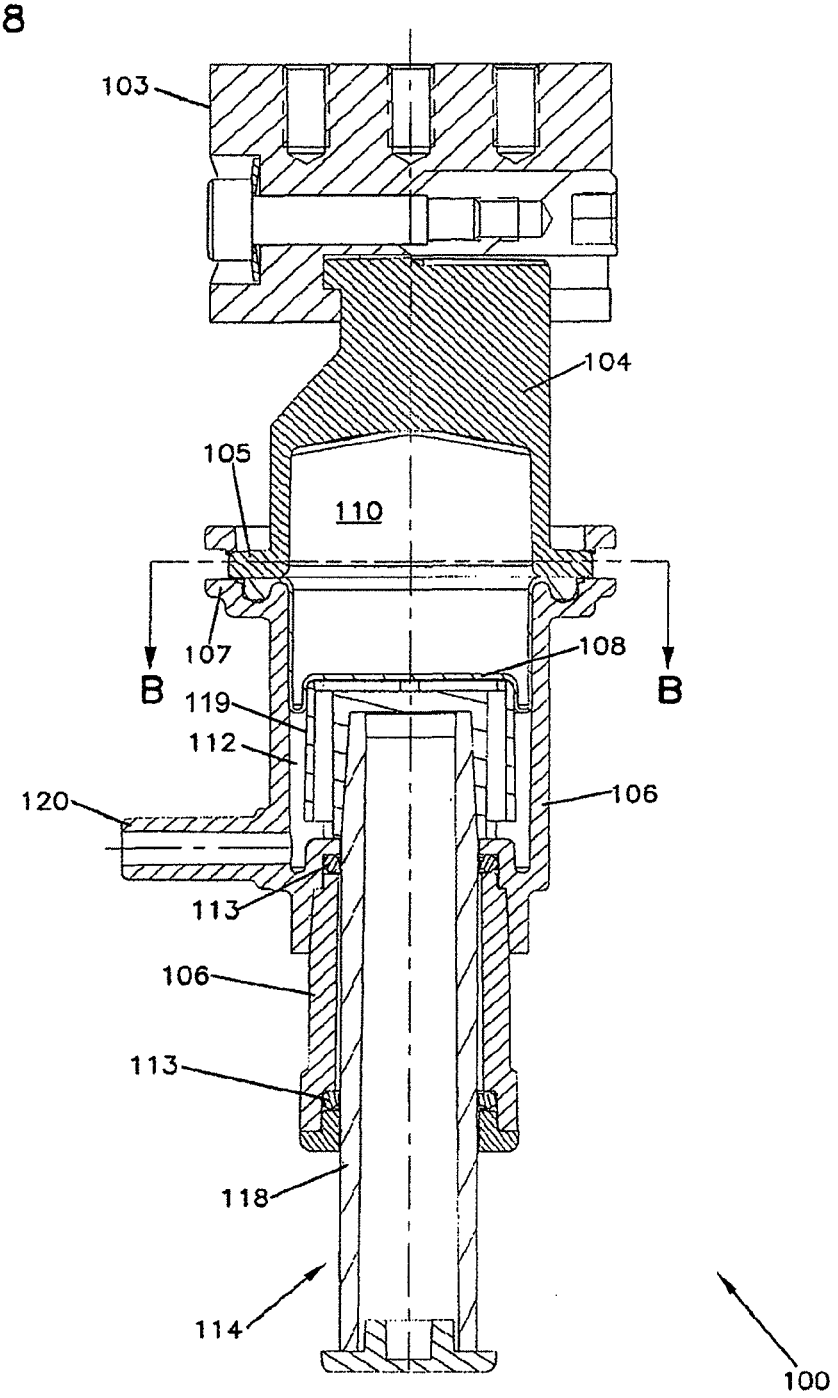
FIG. 8 is a side cross-sectional view of the disposable positive displacement pump of FIG. 4 along a plane including axis A, perpendicular to the plane of FIG. 7.
Figure 9:
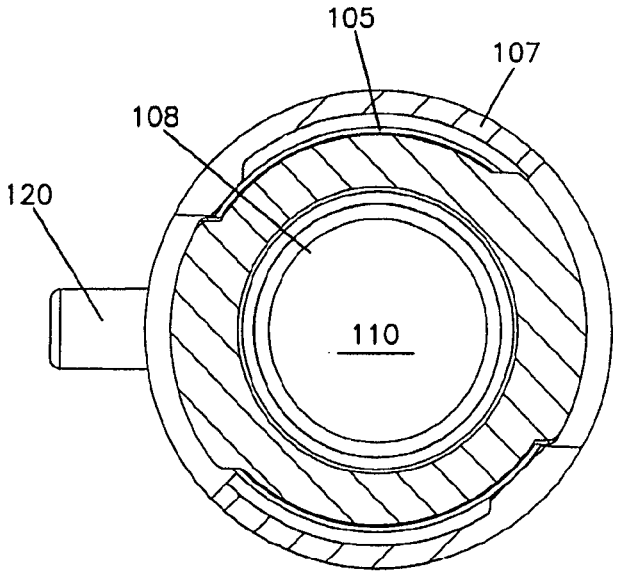
FIG. 9 is a top cross-sectional view of the disposable positive displacement pump of FIG. 4 taken along a plane including axis B.
Figure 10:
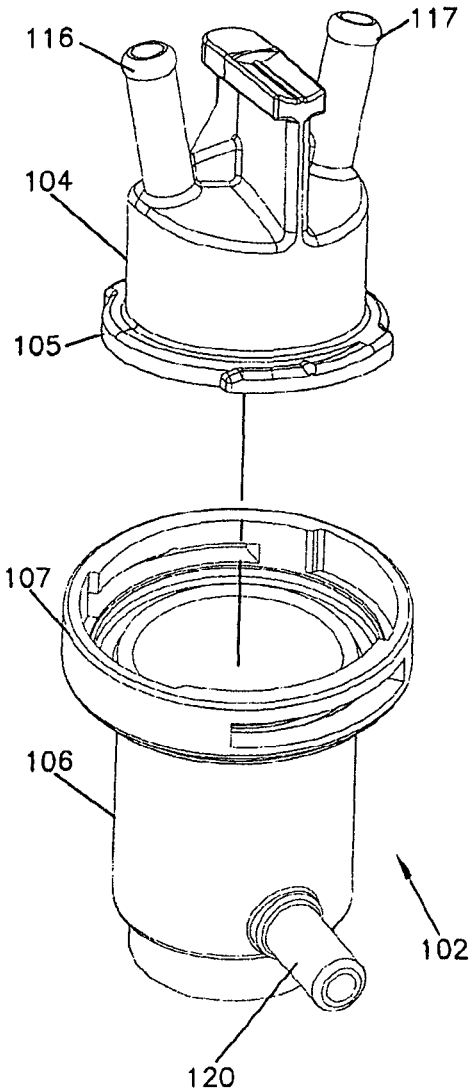
FIG. 10 is an exploded perspective view of a housing of the disposable positive displacement pump of FIG. 4.
Figure 11:
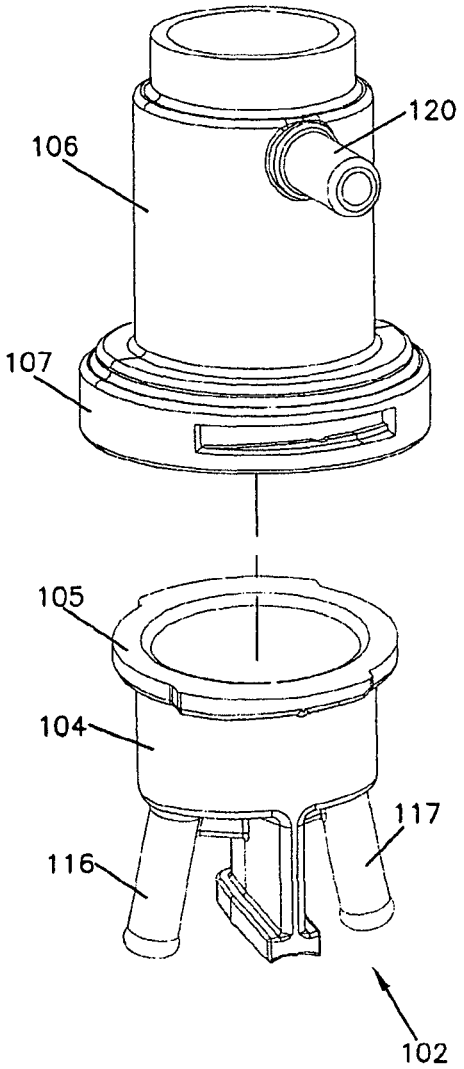
FIG. 11 is an inverted exploded perspective view of a housing of the disposable positive displacement pump of FIG. 4.
Figure 12:
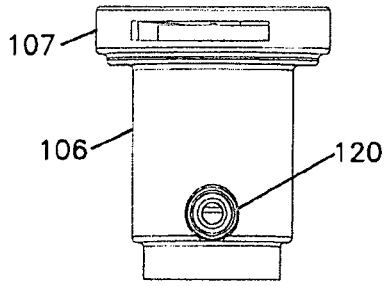
FIG. 12 is a front plan view of a body of the housing of the disposable positive displacement pump of FIG. 4.
Figure 14:
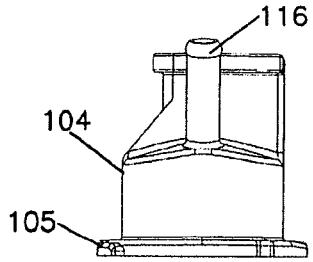
FIG. 14 is a front plan view of a head portion of the pump housing of the disposable positive displacement pump of FIG. 4.
Figure 13:
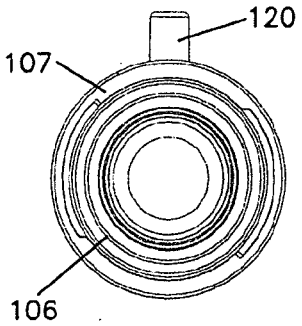
FIG. 13 is a bottom view of the body shown in FIG. 12.
Figure 15:
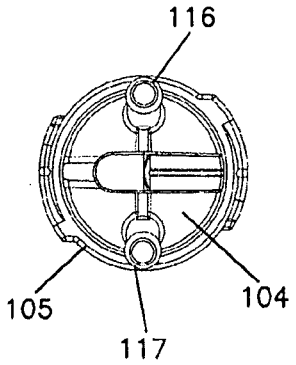
FIG. 15 is a top view of the head portion shown in FIG. 14.

FIGS. 1-3 show various aspects of a positive displacement dosing system 10 according to a possible embodiment of the present disclosure. The positive displacement dosing system 10 is configured for rapid, repeatable delivery of fluids through various fluid delivery tubing and onward to a container or other location configured to accept rapid fluid delivery of a predetermined volume. The system 10 can be manufactured from various types of plastic or other low-cost components configurable for sterile, disposable use. Preferably, the system 10 includes a supply reservoir 12, a distribution manifold 14, a pump assembly 16, and a discharge assembly 18.

Preferably, the supply reservoir 12 is a container configured to hold a large volume of fluid, such as a medicine or other fluid to be used in filling a number of smaller containers of a lesser, predetermined volume. The supply reservoir can be the overall supply of the fluid to the system 10, or can be an intermediate fluid reservoir connected to a larger fluid reservoir (not shown). In a possible embodiment, the supply reservoir 12 is a product supply bag constructed from a flexible, heavy plastic configured to hold a bulk supply of a fluid product, such as a medicine or food product. In a further embodiment, the supply reservoir 12 is a rigid, refillable container for holding the fluid product. Other embodiments of the supply reservoir 12 are possible as well.

Preferably, a distribution manifold 14 is connected to the supply reservoir 12 by flexible tubing 13 and acts to distribute the fluid held by the supply reservoir 12 to one or more pump assemblies 16. The distribution manifold 14 extends laterally along an array of pump assemblies 16, and includes outlets 15 configured for connection to additional tubing 13, referred to as a pump inlet tube, between the manifold 14 and each of the pump assemblies 16, to allow fluid flow through the distribution manifold to each of the pump assemblies. In further embodiments of the system 10, the distribution manifold is not present, and tubing 13 connects the pump assemblies 16 to the supply reservoir 12.

Preferably, the pump assemblies 16 each include a positive displacement pump 20, which can be any of a number of types of positive displacement pumps, such as a rolling diaphragm pump. Such a pump generally includes a piston drive unit configured to reciprocally drive a rolling diaphragm to draw fluid into and propel fluid out of a chamber internal to the pump 20, through fluid openings as shown below in FIGS. 4-15. The pump assemblies 16 optionally also include mounting structures 21 for holding the pumps 20 in place relative to the distribution manifold 14 and external drive mechanism (not shown), such as a piston drive actuator. The mounting structures 21 can include a block having fastener locations arranged to connect to a variety of types of pump mount structures (not shown). Other mounting structures are possible as well.

Each positive displacement pump 20 operates in conjunction with a valve assembly 22 to direct fluids from the supply reservoir 12 to a discharge assembly 18 including a filling needle, or nozzle, 24. The filling needle 24 is configured to direct the fluid to a desired destination, such as a container having a volume approximately corresponding to the predetermined volume of the fluid chamber in the pump 20 or a lesser volume. In the embodiment shown, the discharge assembly 18 includes a flexible discharge tube 25 that connects the positive displacement pump 20 to the filling needle 24, providing a fluid conduit therebetween. In a possible embodiment, each pump 20 connects to a discharge tube 25 and filling needle 24. In further embodiments, other filling arrangements are utilized.

The valve assembly 22 opens and closes fluid passages through the tubing 13, 25 leading to and from the pump 20 to assist in drawing fluid into the pump from the supply reservoir 12 or propelling the fluid from the pump out to the filling needle 24. In a possible embodiment, the valve assembly 22 includes a plurality of pinch valves 23 configured to constrict the tubing 13, 25 to stop fluid flow through that tubing. The constriction results in control of fluid passage through the disposable positive displacement pump 20, as described below. Other valve assembly configurations are possible as well.

Once the system 10 is assembled, it is preferably sterilized with gamma radiation or other method to ensure that the components of the system contacting the fluid, such as the reservoir 12, tubing 13, pump assemblies 16, and discharge assemblies 18, are sufficiently sterile to avoid contamination of liquids dosed by the system. Sterilization of disposable components prior to installation allows the system to be installed and used without requiring clean-in-place or sterilize-in-place procedures.

In a possible operational scenario of the pump 20 and the valve assembly 22, a valve, such as a pinch valve 23, associated with tubing 13 connected to an inlet fluid opening of the pump 20 opens at the same time a valve associated with discharge tubing 25 connected to an outlet fluid opening of the pump closes. The pump 20 is actuated to enlarge an internal fluid chamber, as described below in conjunction with FIGS. 4-15, to draw fluid into the fluid chamber through the inlet opening. The valve positions then reverse, and the pump 20 is actuated to compress the internal fluid chamber and propel the fluid through the outlet opening into the discharge tubing 25 and to the filling needle 24.

The pump 20 preferably is disposable, and can be completely replaced by another pump within the system 10 by detaching and removing the old pump, installing a new pump in the system, and reconnecting tubing to the new pump. Alternately, the system 10 can be replaced, and the pump 20 is replaced alongside other components of the system, such as a plurality of pumps 20, tubing 13, and optionally the distribution manifold 14 or supply reservoir 12. The pump 20 and other components that are removed from the system 10 can then be disposed of and replaced by a new pump 20 or assembly 10. Further operational scenarios are possible for use, maintenance, and replacement of the pump 20 are possible as well.

Referring now to FIGS. 4-15, various aspects of a disposable positive displacement pump 100 are disclosed. Preferably, the disposable positive displacement pump 100 is operable as pump 20 in the system 10 of FIGS. 1-3, or in various other configurations of positive displacement dosing systems. The disposable positive displacement pump 100 is configured to be fully disposable, in that a large majority, if not all of the pump components are manufactured from low-cost materials such as plastics or other resilient polymeric materials, and the pump 100 as a whole is intended to be periodically replaced.

The disposable positive displacement pump 100 includes a pump housing 102 formed from a head portion 104 and a body 106. The pump housing 102 attaches to a mounting structure 103, which in the embodiment shown is located on the head portion 104. The mounting structure 103 can include a connection system, such as a nut and bolt fastening system, for mounting the pump at a desired location. The mounting structure 103 can be located on other locations on the pump as well.

The head portion 104 and body 106 are sealed at cooperating flanges 105, 107, respectively, preventing fluid or air from escaping from the pump housing 102 unless through an opening or port formed through the pump housing. In the embodiment shown, the head portion 104 sealingly attaches to the body 106 in a twist lock configuration via complementary flanges 105, 107. Optionally, an epoxy or other adhesive can be applied between the flanges 105, 107 to prevent disengagement of the flanges. In a further possible embodiment, the head portion 104 and base portion 106 are integrally formed, preventing a user from opening the pump to access components internal thereto. Other attachment methods are possible.

The pump housing 102 houses a rolling diaphragm 108, which separates and defines a fluid chamber 110 in the head portion 104, and a pneumatic chamber 112 in the body 106. The rolling diaphragm 108 is flexible, and can be selectively driven using a piston drive unit 114 housed in the body 106 to compress the fluid chamber 110. The rolling diaphragm 108 can be made from rubber, flexible plastic, or some other material capable of sealing the fluid chamber 110 to keep it isolated from the piston drive unit 114 and pneumatic chamber 112, maintaining sterility, if required, of the fluid to be pumped. In the embodiment shown, the rolling diaphragm 108 is held in position by compression between the flanges 105, 107 when the pump is fully assembled. Other connective and sealing configurations are possible as well.

The head portion 104 further includes one or more fluid passage openings. In the embodiment shown, the head portion includes two fluid passage openings, which may be configured as an input port 116 and an output port 117, respectively. Additional fluid passage openings may be included in the head portion 104 as well. The fluid passage openings 116, 117 are in fluidic connection with the fluid chamber 110, and are configured to accept connection of tubing for directing fluids entering and exiting the fluid chamber. Fluid passes through one or both of the fluid passage openings 116, 117 as the rolling diaphragm 108 is actuated by the piston drive unit 114, causing expansion and contraction of the fluid chamber 110. In a further embodiment, the head portion 104 includes a single fluid passage opening, configured to have a T-fitting connected to allow directional flow of fluids through a dosing system.

The body 106 may be constructed from one or more pieces, and as shown includes a plurality of concentrically held components. As previously mentioned, the body 106 houses the piston drive unit 114, which includes a piston 118. The body 106 includes a plurality of o-ring or seals 113 configured to assist in forming the vacuum in the pneumatic chamber 112 by surrounding the piston 118. The piston drive unit 114 also includes a head portion 119 of a smaller diameter than the fluid chamber 110, but a larger diameter than the piston 118, allowing the piston drive unit to actuate the rolling diaphragm while remaining within the body 106. The piston drive unit 114, when actuated by a drive mechanism (not shown), generates a compressive force forcing the piston drive unit 114 toward the head portion 104 of the body 102. The motion of the piston drive unit 114 is reversed by a vacuum or other pneumatic system (not shown) connected to the body 106 by a pneumatic port 120 connected to the pneumatic chamber 112. Use of a vacuum to draw the piston drive unit 114 away from the head portion 104 prevents backlash of the piston drive unit 114 to improperly drive the rolling diaphragm 108.

In operation, the drive mechanism can push the piston drive unit 114 and force the rolling diaphragm 108 further into the head portion 104 of the pump housing 102 and shrinking the fluid chamber 110, in opposition to the vacuum created in the pneumatic chamber 112. When the drive mechanism ceases pushing the piston drive unit 114 and air is removed from the pneumatic chamber 112 by the vacuum or other pneumatic system connected to the pneumatic port 120, the vacuum created in the pneumatic chamber causes the piston drive unit 114 to recede into the body 106. This causes the rolling diaphragm 108 to move toward the body 106, thereby re-expanding the fluid chamber 110. By alternately driving the piston drive unit 114 and removing air from the pneumatic chamber 112, the piston drive unit 114 reciprocates, causing corresponding expansion and compression of the fluid chamber 110. The expansion and compression of the fluid chamber 110, in conjunction with use of the valve assembly shown above in FIGS. 1-3, allows the pump to direct fluids through a system.

Figure 16:
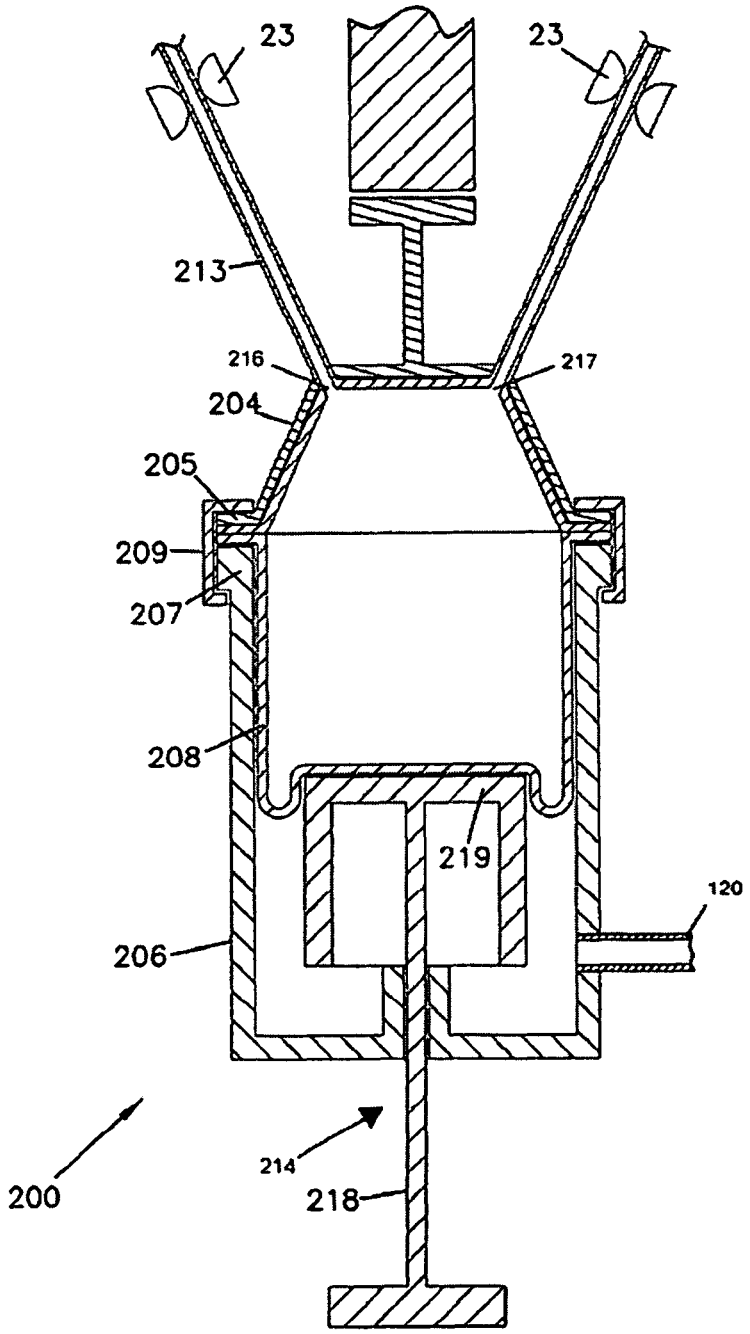
FIG. 16 is a schematic view of a disposable positive displacement pump according to a second possible embodiment of the present disclosure.

Referring now to FIG. 16, a pump 200 is shown according to a second possible embodiment of the present disclosure. In the embodiment shown, the pump 200 includes a head portion 204 and body 206 surrounding a bladder 208. The bladder 208 can be either one integrated piece or two pieces as shown. The head portion 204 includes openings 216, 217, through which the head 204 allows tubing 213 to be integrally connected to the bladder 208. The body 206 contains a piston drive unit 214, including a piston 218 and head portion 219 corresponding to the piston and head portion of FIGS. 4-15.

The bladder 208 contains the fluid within the pump 200, and the combination of the head portion 204 and the body 206 provide a shell configured to hold and compress the bladder 208. Compression of a portion of the bladder 208 between the flanges 205, 207 holds the bladder 208 in place when the pump is fully assembled. The bladder 208 is actuated by a piston drive unit 214 to force liquid held within it outward through one of the openings 216, 217 and through tubing 213 connected therethrough, analogously to the embodiment of FIGS. 4-15. The lower portion of bladder 208 can be operated in a rolling diaphragm motion.

The head portion 204 and body 206 are clamped at cooperating flanges 205, 207, respectively, preventing air from escaping from the pump 200. A clamp 209 connects around the protruding flanges 205, 207 to maintain secure attachment of the head portion 204 and body 206 and bladder 208 between. The clamp 209 can be any type of clamp configured to connect around the cooperating flanges 205, 207. Optionally, an epoxy can also be applied among the flanges 205, 207, and the clamp 209 to prevent disengagement of the flanges. Alternative clamping portions are possible as well.

The bladder 208 and tubing 213 come in contact with a product or fluid. As such, the bladder 208 and tubing 213 can be pre-assembled, pre-sterilized for use, and disposable after use.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A disposable positive displacement pump comprising:

a pump housing having a head portion non-disengagingly connected to a body, the head portion having a plurality of fluid passage openings, the body including a plurality of separate concentrically positioned components, a pneumatic chamber and a pneumatic port;

a rolling diaphragm internal to the pump housing and defining a fluid chamber within the pump housing; and a piston drive unit at least partially retained within the pump housing by the body, the piston drive unit at least partially formed from plastic and configured to reciprocally drive the rolling diaphragm in an axial direction to move fluid into the fluid chamber via a first of the plurality of fluid passage openings and out of the fluid chamber via a second of the plurality of fluid passage openings, and wherein at least a first seal and a second seal are spaced apart and positioned between a piston and the plurality of separate concentrically positioned components of the body, the first and second seals configured to assist in maintaining a vacuum in the pneumatic chamber;

wherein the first seal is positioned between the piston and a first component of the plurality of separate concentrically positioned components of the body, and the second seal is positioned between the piston and a second component of the plurality of separate concentrically positioned components of the body, and wherein the first seal is positioned inward of the pneumatic port in a radial direction, the radial direction perpendicular to the axial direction, and wherein the pump housing, the rolling diaphragm, and the piston drive unit are non-disengageable and fully disposable.

2. The disposable positive displacement pump of claim 1, wherein the pump housing is plastic.

3. The disposable positive displacement pump of claim 1, wherein the piston is plastic.

4. The disposable positive displacement pump of claim 1, wherein the head portion and the body are integrally connected.

5. The disposable positive displacement pump of claim 1, wherein the fluid chamber has a predetermined maximum volume.

6. The disposable positive displacement pump of claim 1, wherein the piston drive unit includes the piston.

7. The disposable positive displacement pump of claim 1, wherein the pneumatic port provides an air outlet allowing a vacuum connection to the body.

8. The disposable positive displacement pump of claim 7, wherein the vacuum connection controls withdrawal of the piston drive unit.

9. A method of dispensing a fluid, the method comprising:

pumping a fluid from a fluid source using a disposable positive displacement pump, the pump comprising:

a pump housing having a head portion non-disengagingly connected to a body, the head portion having a plurality of fluid passage openings, the body including a plurality of separate concentrically positioned components, a pneumatic chamber and a pneumatic port;

a rolling diaphragm internal to the pump housing and defining a fluid chamber within the pump housing;

a piston drive unit at least partially retained within the pump housing by the body, the piston drive unit at least partially formed from plastic and configured to reciprocally drive the rolling diaphragm in an axial direction to move fluid into the fluid chamber via a first of the plurality of fluid passage openings and out of the fluid chamber via a second of the plurality of fluid passage openings, and wherein at least a first seal and a second seal are spaced apart and positioned between a piston and the plurality of separate concentrically positioned components of the body, the first and second seals configured to assist in maintaining a vacuum in the pneumatic chamber;

wherein the first seal is positioned between the piston and a first component of the plurality of separate concentrically positioned components of the body, and the second seal is positioned between the piston and a second component of the plurality of separate concentrically positioned components of the body, and wherein the first seal is positioned inward of the pneumatic port in a radial direction, the radial direction perpendicular to the axial direction, and wherein the pump housing, the rolling diaphragm, and the piston drive unit are non-disengageable and fully disposable.

10. The method of claim 9, further comprising replacing the disposable positive displacement pump with a second disposable positive displacement pump.

11. The method of claim 10, further comprising disposing of the disposable positive displacement pump.

12. The method of claim 10, wherein replacing the disposable positive displacement pump comprises disconnecting the disposable positive displacement pump from the fluid source.

13. The method of claim 9, wherein the head portion and the body are integrally connected.

14. A disposable positive displacement pump for use in a sterile disposable positive displacement dosing system, the pump comprising:

a pump housing having an integrally formed head portion non-disengagingly connected to a body, the head portion having a plurality of fluid passage openings, and the body including a plurality of separate concentrically positioned components, and a pneumatic chamber;

a rolling diaphragm internal to the pump housing and defining a fluid chamber within the head portion;

a piston drive unit at least partially retained within the pump housing by the body, the piston drive unit at least partially formed from plastic and configured to reciprocally drive the rolling diaphragm in an axial direction to move fluid into the fluid chamber via a first of the plurality of fluid passage openings and out of the fluid chamber via a second of the plurality of fluid passage openings, and wherein at least a first seal and a second seal are spaced apart and positioned between a piston and the plurality of separate concentrically positioned components of the body, the first and second seals configured to assist in maintaining a vacuum in the pneumatic chamber; and a pneumatic port located on the body for providing an air outlet allowing a vacuum connection to the body and controlling withdrawal of the piston drive unit;

wherein the first seal is positioned between the piston and a first component of the plurality of separate concentrically positioned components of the body, and the second seal is positioned between the piston and a second component of the plurality of separate concentrically positioned components of the body, and wherein the first seal is positioned inward of the pneumatic port in a radial direction, the radial direction perpendicular to the axial direction, and wherein the pump housing, the rolling diaphragm, and the piston drive unit are non-disengageable and fully disposable.

15. The disposable positive displacement pump of claim 14, wherein the pump housing is plastic.

16. The disposable positive displacement pump of claim 14, wherein the piston is plastic.

17. The disposable positive displacement pump of claim 14, wherein the pump is pre-sterilized.

* * * * *